United States Patent [19]

Renouard

[11] Patent Number: 4,958,583

[45] Date of Patent: Sep. 25, 1990

[54] WATER SKI SAFETY APPARATUS

[76] Inventor: Bruce T. Renouard, 4430 Cedarbrush Dr., Dallas, Tex. 75229

[21] Appl. No.: 335,780

[22] Filed: Apr. 10, 1989

[51] Int. Cl.[5] ..... A63C 15/06

[52] U.S. Cl. ..... 114/253; 441/69

[58] Field of Search ..... 114/253, 254; 441/68, 441/69, 65, 72, 73

[56] References Cited

U.S. PATENT DOCUMENTS

| | | | |
|---|---|---|---|
| 2,536,681 | 1/1951 | Frieder et al. . | |
| 2,944,507 | 7/1960 | Beal | 114/253 |
| 3,296,996 | 1/1967 | Miller | 114/253 |
| 4,392,833 | 7/1983 | Hayden | 114/253 |
| 4,733,628 | 3/1988 | Baughman . | |
| 4,738,414 | 4/1988 | McCulloh | 114/253 |
| 4,766,837 | 8/1988 | Parish . | |
| 4,813,369 | 3/1989 | Moreland | 441/68 |

*Primary Examiner*—Sherman Basinger
*Assistant Examiner*—Stephen P. Avila
*Attorney, Agent, or Firm*—Daniel V. Thompson

[57] ABSTRACT

A water ski safety apparatus includes a first coupler rope for connecting the apparatus to a handle, a second coupler rope for connecting the apparatus to the boat, and deceleration structure for decelerating the apparatus when the apparatus is caused to accelerate toward the boat.

13 Claims, 2 Drawing Sheets

WATER SKI SAFETY APPARATUS

TECHNICAL FIELD

The present invention relates to recreational and boating equipment, and more particularly to apparatus for protecting boat operators from water ski handles when released.

BACKGROUND ART

Water skiing is a sport that has participants in more than 40 countries on at least four continents. In the United States alone, over 18 million persons a year participate in the sport of water skiing. Several water ski federations throughout the world actively promote competitions and demonstrations of water skiing involving high skill and significant athletic ability of the participants.

A significant hazard involved in highly advanced, competitive water skiing is the hazard to the boat occupants of a flying water ski handle which has been suddenly released. A typical advanced water skier can place as much as 1,000 pounds of tension on the water ski rope, which typically has a length of between 35 and 75 feet, with more expert skiers using shorter ropes within such range. Such tension can cause the rope to stretch as much as three inches, and the mounting pole on the boat can flex as much as 1½ inches. When the skier falls and/or suddenly releases the handle, the resilience of the rope and pole causes the handle to fly forward toward the boat at a very high velocity. The handle, which weighs between 1 and 1½ pounds, could thus travel forward and strike the boat and its occupants with the obvious potential for bodily injury and property damage. It is now conventional for professional competition ski boats to have an elaborate shield to protect the occupants from flying handles, but shields have not come into widespread use among water ski participants in non-competition situations.

It can thus be seen that there presently exists a need for increasing the safety of water skiing by preventing the acceleration of water ski handles to high speed upon release by the skier.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION

Figure 1:
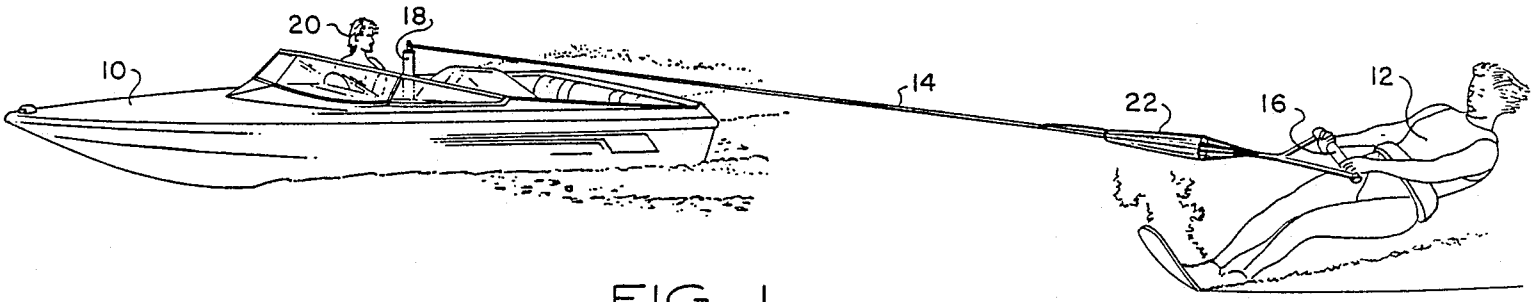
FIG. 1 is a perspective view of the invention used in a water typical skiing application.

Referring initially to FIG. 1, boat 10 is shown pulling water skier 12 by way of rope 14. Water skier 12 is pulled through the water by gripping handle 16. It will be appreciated that skier 12 is capable of putting enormous tension on rope 14 and its mounting pole 18, which is located near the center of boat 10 and directly behind or adjacent to boat operator 20. Thus, in accordance with the invention, a water ski safety apparatus 22 is provided to decelerate handle 16 upon release.

Figure 2:
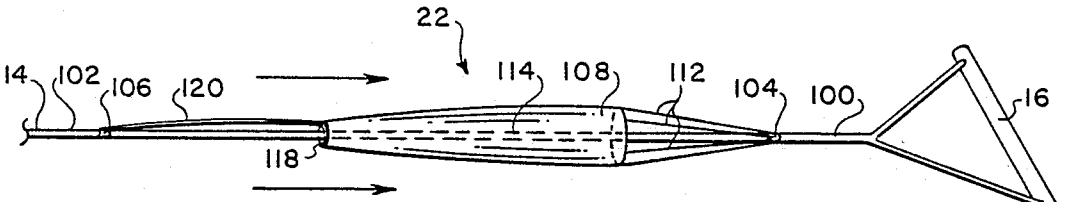
FIG. 2 is a perspective view of the apparatus of the present invention in a collapsed state.
Figure 3:
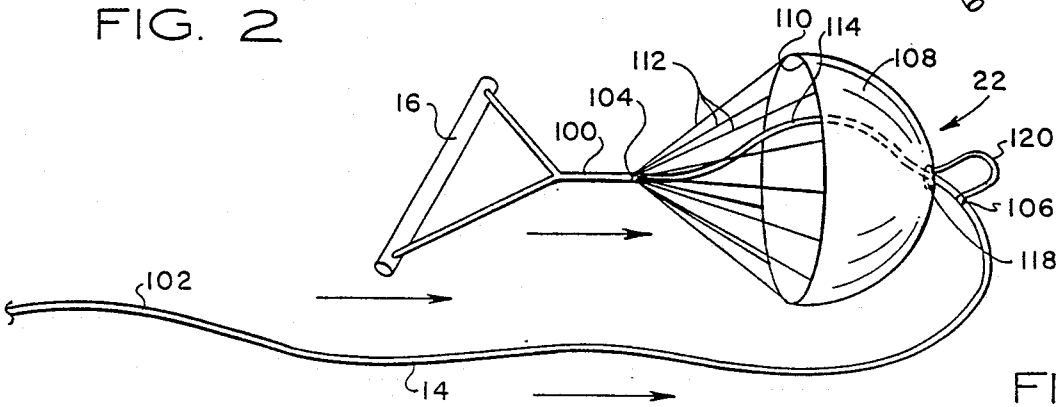
FIG. 3 is a perspective view of the apparatus of FIG. 2 in a deployed state.

Referring now to FIGS. 2 and 3, rope 14 includes a first coupler rope 100 connecting apparatus 22 to handle 16. Preferably, first coupler rope 100 is relatively short such that handle 16 is located relatively close to apparatus 22, as shown. Rope 14 also includes a second coupler rope 102, which connects apparatus 22 to the boat (not shown). First coupler rope 100 is connected to first end 104 of apparatus 22, and second coupler rope 102 is connected to second end 106 of apparatus 22.

Apparatus 22 includes structure for decelerating apparatus 22, and thereby the attached handle 16, when the handle 16 is released and accelerated in the direction of the boat, as shown in FIG. 3. It will be understood that airflow is in the direction shown in the arrows in FIGS. 2 and 3, and that upon release, handle 16 flies towards the boat opposite the airflow, as shown in FIG. 3. Apparatus 22 is actuated by a reduction in tension placed on the apparatus by the first and second coupler ropes 100 and 102. The coupler ropes are under great tension when in normal use, as shown in FIG. 2, but under greatly reduced tension when the handle is released as shown in FIG. 3.

The preferred deceleration structure includes an envelope 108 for producing drag relative to air flowing past apparatus 22 for decelerating the apparatus. Envelope 108, as shown in FIG. 3, acts similar to a drag parachute used in other environments to decelerate moving objects by way of atmospheric drag. Envelope 108 is formed of a flexible sheet material such as fabric or plastic having a periphery 110.

Deployment structure is provided to cause envelope 108 to change from the collapsed state shown in FIG. 2 to the deployed state shown in FIG. 3. Envelope 108 is deployed when the tension in coupler ropes 102 and 100 is reduced and the handle and apparatus are accelerated opposite the airflow past the handle and apparatus. A plurality of cords 112 extend between periphery 110 of envelope 108 and first end 104 of the apparatus 12. A third rope 114 extends between first and second ends 104 and 106, respectively, through an aperture 118 in envelope 108. Aperture 118 and third rope 114 are sized to permit relative movement between them when envelope 108 is actuated from the collapsed state shown in FIG. 2 to the deployed state shown in FIG. 3. An elastic cord 120 extending between envelope 108 adjacent aperture 118 stretches envelope 108 and cords 112 when the first, second and third ropes are under tension, as shown in FIG. 2, into the collapsed state. It will be appreciated that the total length of elastic cord 120, envelope 108 and cords 112 is slightly less than that of third rope 114, such that envelope 108 is collapsed to a relatively smooth and stable shape when the apparatus is in normal use. However, when handle 16 is suddenly released, airflow into envelope 108 is sufficient to deploy the envelope and decelerate the handle prior to striking the boat or its occupants.

Figure 4:
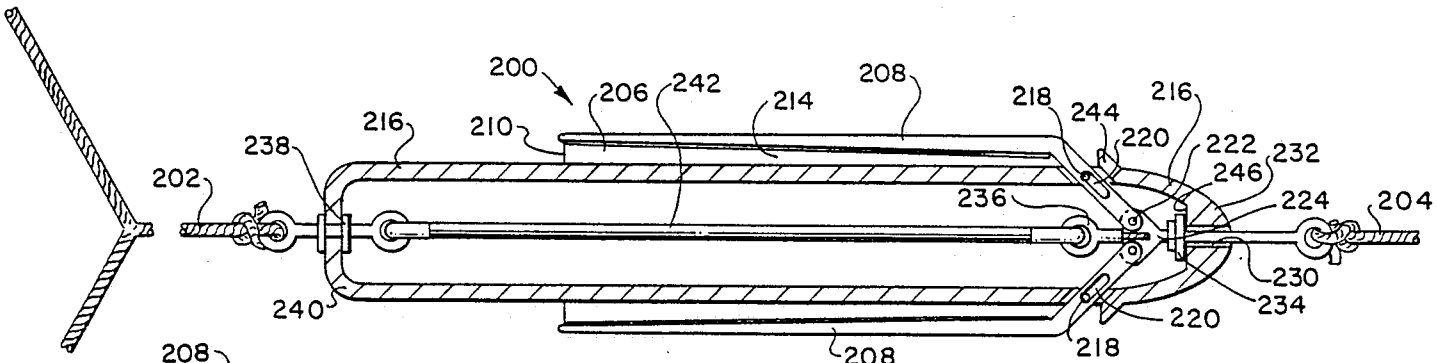
FIG. 4 is a partially broken away side view of a second embodiment of the invention in a collapsed state.
Figure 5:
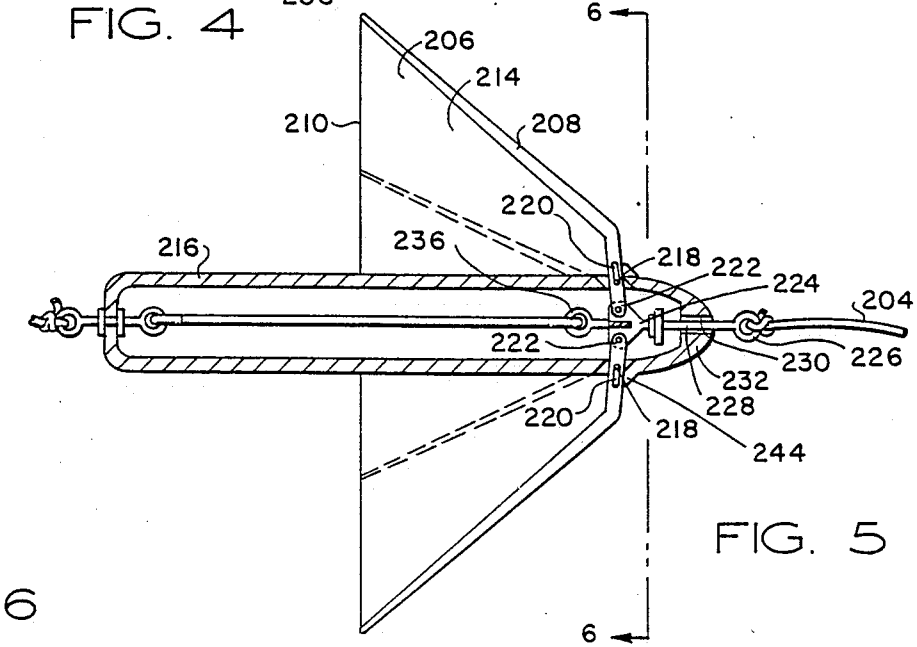
FIG. 5 is a view similar to FIG. 4 with the apparatus in a deployed state.
Figure 6:
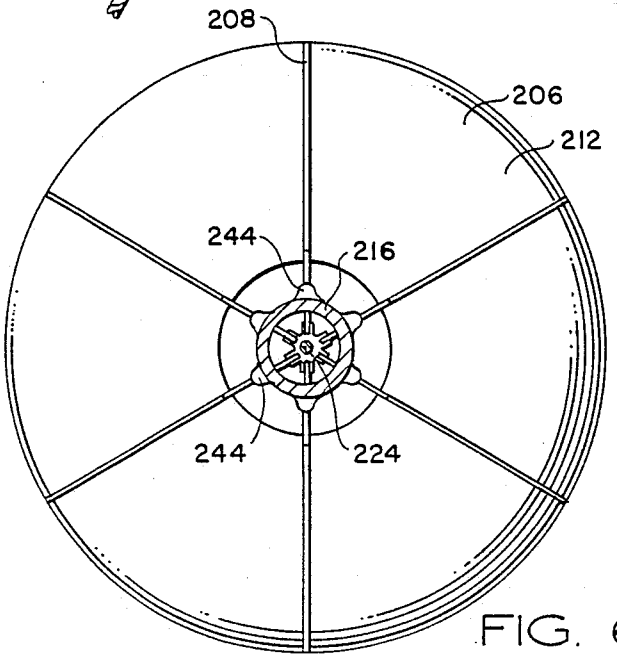
FIG. 6 is a sectional view taken along lines 6—6 of FIG. 5.

Referring now to FIGS. 4, 5 and 6, an alternative embodiment of the invention includes apparatus 200 extending between a handle (not shown) to the left of FIG. 4 and boat (not shown) to the right of the apparatus shown in FIG. 4. First coupler rope 202 connects apparatus 200 to the handle, and second coupler rope 204 connects apparatus 200 to the boat. The deceleration structure for the alternative embodiment includes an envelope 206 for producing drag relative to air flowing past the apparatus when the envelope is deployed from a collapsed state as shown in FIG. 4 to a deployed state as shown in FIGS. 5 and 6. The deployment structure includes a plurality of finger members 208, preferably six in number as shown, which extend from periphery 210 along the outer side 212 (FIG. 6) of envelope 208. Envelope 208 also includes an inner side 214.

Finger members 208 are hingedly connected to a tubular body 216 at pivot points 218. Pivot points 218 ride in elongated slots 220 formed in finger members 208. The inner ends 222 of fingers 208 are pivotally mounted to a central member 224. Central member 224 is connected to second coupler rope 204 by way of an eyelet 226 and shaft 228. Shaft 228 is sized to longitudinally slide in aperture 230 centrally located in the front end 232 of body 216. A stop 234 is also included on central member 224. Central member 224 also includes a rear eyelet 226, which is connected to a fixed coupler 238 fixed to the rear end 240 of body 216 by way of an elastic cord 242. Shoulders 244 extend outwardly from body 216 to contact finger members 208 when in the deployed position shown in FIGS. 5 and 6.

In operation, the alternative embodiment of the invention is maintained in the deployed state by the tension applied to body 216 by the first and second coupler ropes. Second coupler rope 204 under tension causes central member 224 to slide forward until stop 234 contacts the inner end 246 of end 232. Because of the pivotal mounting of finger members 208 with respect to body 216, envelope 206 is maintained in the collapsed state shown in FIG. 4. When tension on the apparatus 200 is released, such as when the handle is suddenly released, elastic cord 242 causes central member 224 to slide rearwardly in body 216 thereby causing finger members to pivot to the positions shown in FIGS. 5 and 6. The pivoting of finger members 208 is enabled by the longitudinal slots 220 in finger members 208 translating with respect to pivot points 218 and the pivotal connections of finger members 208 to central member 224.

Whereas the present invention has been described with respect to specific embodiments thereof, it will be understood that various changes and modifications will be suggested to one skilled in the art, and it is intended to encompass such changes and modifications as fall into the scope of the appended claims.

I claim:

1. Water ski safety apparatus for use with a boat, comprising:

a first coupler for connecting the apparatus to a handle;

a second coupler for connecting the apparatus to the boat;

deceleration means for decelerating said apparatus when the apparatus is caused to move toward the boat; and wherein a first rope extends between the handle and a first end of said apparatus, a second rope extends between the boat and a second end of the apparatus, and said deceleration means includes actuation means for actuating the deceleration means, said actuation means being responsive to a reduction in tension placed on said apparatus by said first and second ropes.

2. The apparatus of claim 1 wherein said deceleration means includes an envelope for producing drag relative to air flowing past said apparatus such that said apparatus is thereby decelerated.

3. The apparatus of claim 2 wherein said actuation means includes deployment means for causing said envelope to change from a collapsed state to a deployed state upon a reduction of tension on said ropes, such that when said ropes are under tension in normal use said envelope is in said collapsed state, and when said tension is reduced said envelope is deployed to produce drag and decelerate the apparatus.

4. The apparatus of claim 3 wherein said envelope is formed of a flexible sheet material having a periphery, and said deployment means includes a plurality of cords extending between said periphery of said envelope and said first end of said apparatus.

5. The apparatus of claim 4 wherein said deployment means further comprises a third rope extending between said first and second ends of said apparatus and through an aperture in the center of the envelope, said aperture and third rope being sized to permit relative movement therebetween when said envelope is actuated from said collapsed state to said deployed state.

6. The apparatus of claim 5 wherein said deployment means further comprises spring means connecting said envelope to said third rope for collapsing said envelope when said third rope is under tension.

7. The apparatus of claim 6 wherein said spring means is an elastic cord.

8. The apparatus of claim 7 wherein said elastic cord is connected to said envelope adjacent said aperture.

9. The apparatus of claim 3 wherein said envelope is formed of a flexible sheet material having a periphery and two sides, and said deployment means includes a plurality of finger members attached to said periphery and extending along one of said two sides of said envelope to a central portion of said apparatus.

10. The apparatus of claim 9 wherein said finger members are hingedly connected to a body of said apparatus for movements by said actuation means between said collapsed and said deployed positions.

11. The apparatus of claim 10 wherein said body is fixed to said first coupler, said finger members are pivotally mounted to a central member, said central member is connected to said second coupler, said second coupler and central member are mounted for longitudinal sliding movements relative said body, and further comprising spring means extending between said first coupler and said central member for collapsing said envelope when said first and second ropes are under tension.

12. Water ski safety apparatus for use with a boat, comprising:

a first coupler for connecting the apparatus to a handle, said first coupler including a first rope extending between the handle and a first end of said apparatus;

a second coupler for connecting the apparatus to the boat said second coupler including a second rope extending between the boat and a second end of the apparatus;

deceleration means for decelerating said apparatus when the apparatus is caused to move toward the boat;

said deceleration means including actuation means for actuating the deceleration means said actuation means being responsive to a reduction in tension placed on said apparatus by said first and second ropes;

said deceleration means including an envelope for producing drag relative to air flowing past said apparatus such that said apparatus is thereby decelerated;

said actuation means including deployment means for causing said envelope to change from a collapsed state to a deployed state upon a reduction of tension on said ropes, such that when said ropes are under tension in normal use said envelope is in said collapsed state, and when said tension is reduced said envelope is deployed to produce drag and decelerate the apparatus;

said envelope being formed of a flexible sheet material having a periphery;

said deployment means including a plurality of cords extending between said periphery of said envelope and said first end of said apparatus;

said deployment means further comprising a third rope extending between said first and second ends of said apparatus and through an aperture in the center of the envelope, said aperture and third rope being sized to permit relative movement therebetween when said envelope is actuated from said collapsed state to said deployed state; and said deployment means further comprising an elastic cord extending between said envelope adjacent said aperture to said third rope for collapsing said envelope when said third rope is under tension.

13. Water ski safety apparatus for use with a boat, comprising:

a first coupler for connecting the apparatus to a handle, said first coupler including a first rope extending between the handle and a first end of said apparatus;

a second coupler for connecting the apparatus to the boat said second coupler including a second rope extending between the boat and a second end of the apparatus;

deceleration means for decelerating said apparatus when the apparatus is caused to move toward the boat;

said deceleration means including actuation means for actuating the deceleration means;

said actuation means being responsive to a reduction in tension placed on said apparatus by said first and second ropes;

said deceleration means including an envelope for producing drag relative to air flowing past said apparatus such that said apparatus is thereby decelerated;

said actuation means including deployment means for causing said envelope to change from a collapsed state to a deployed state upon a reduction of tension on said ropes, such that when said ropes are under tension in normal use said envelope is in said collapsed state, and when said tension is reduced said envelope is deployed to produce drag and decelerate the apparatus;

said envelope being formed of a flexible sheet material having a periphery and two sides;

said deployment means including a plurality of finger members attached to said periphery and extending along one of said two sides of said envelope to a central member;

said finger members being hingedly connected to a body of said apparatus for movements by said actuation means between said collapsed and said deployed positions;

said body being fixed to said first coupler, said finger members being pivotally mounted to said central member, said central member being connected to said second coupler, said second coupler and central member being mounted for longitudinal sliding movements relative said body; and an elastic cord extending between said first coupler and said central member for collapsing said envelope when said first and second ropes are under tension.

* * * * *